United States Patent [19]

Grönert et al.

[11] Patent Number: 4,766,752

[45] Date of Patent: Aug. 30, 1988

[54] MACHINE TOOL FOR THE PRODUCTION OF TUBULAR COMPONENTS

[75] Inventors: Heinz Grönert, Emmering; Manfred Eckert, Dachau; Henning von Petersdorff, Puchheim; Johann Münich, Munich; Maximilian Hammer, Windach; Günther Nuissl, Karlsfeld; Klaus Bergen, Oberschweinbach; Josef Appoloner; Anton Pfeil, both of Munich; Willibald Huber, Jetzendorf; Klaus Kiessling, Munich, all of Fed. Rep. of Germany

[73] Assignee: Man Technologie GmbH, Munich, Fed. Rep. of Germany

[21] Appl. No.: 937,965

[22] Filed: Dec. 5, 1986

[30] Foreign Application Priority Data

Dec. 20, 1985 [DE] Fed. Rep. of Germany ..... 3545506

[51] Int. Cl.[4] ..... B21B 19/14

[52] U.S. Cl. ..... 72/84; 72/110

[58] Field of Search ..... 72/84, 85, 86, 91, 96, 72/110, 111

[56] References Cited

U.S. PATENT DOCUMENTS

| | | | |
|---|---|---|---|
| 949,464 | 2/1910 | Dean | 72/244 |
| 1,528,832 | 3/1925 | Kellogg | 72/91 |
| 1,610,593 | 12/1926 | Roeckner | 72/111 |
| 2,305,794 | 12/1942 | Roeckner | 72/86 |
| 3,287,951 | 11/1966 | Widera | 72/85 |
| 3,517,534 | 6/1970 | Werner et al. | 72/85 |

*Primary Examiner*—Lowell A. Larson

*Attorney, Agent, or Firm*—Roberts, Spiecens & Cohen

[57] ABSTRACT

In an apparatus for rolling the walls of a tube in order to decrease the wall thickness and so increase the length of the tube by the use of pairs of rolls of which one roll is outside the tube wall and the other roll is inside it and in which relative axial motion and relative rotation takes place between the tube and the roll pairs, an increase in the possible length of tube which may be rolled is produced by having all the rollers carried on means extending from a common support structure on which a holder for one end of the tube is also carried.

13 Claims, 4 Drawing Sheets

MACHINE TOOL FOR THE PRODUCTION OF TUBULAR COMPONENTS

BACKGROUND OF THE INVENTION

The invention relates to machine tools and, more particularly but not exclusively, to a machine tool for rolling the walls of hollow cylindrical components, comprising a support for holding the workpiece and at least one pair of rolls to be pressed against the wall of the workpiece (that is to say a pair of wall thickness reducing rolls) such that one roll engages the wall of the workpiece internally and the other roll engages the wall of the workpiece externally.

A machine tool of this type is described in US patent 3,287,951. In the roll wall thickness reduction method by rolling, long tubes are produced from short thick-walled tubular blanks. In the known apparatus the tubular blank is clamped in a holder and caused to rotate. At the free end of the workpiece remote from the holder there is an axially traveling roll support which presses two pairs of rolls internally and externally against the wall of the workpiece and in the course of the rolling operation the rolls are displaced axially towards the support. An axially extending space is left between the roll support and the position at which the rolls are in engagement with the tube being rolled to accept the tube as its length increases owing to the reduction in wall thickness by rolling. However, this space is limited in the axial direction by the transverse part of the roll support so that only relatively short tubes may be produced with the known apparatus.

SUMMARY OF THE INVENTION

One object of the invention is to devise an apparatus of the initially mentioned type such that it may be used without any limitation to the length of the tube owing to obstruction by a part of the machine tool.

In order to achieve the above or other objects appearing in the course of the present specification and claims, a machine tool for the ring rolling of hollow cylindrical workpieces provided is comprising a holder for the workpiece, at least one pair of rolls to be pressed against the wall of the workpiece so that one roll engages the workpiece wall internally and the other roll engages it externally, respective roll carriers for the rolls, the roll carriers and the holder for the workpiece being mounted so that they may cause relative axial and rotary motion between the rolls on the one hand and the workpiece on the other.

In accordance with one possible form of the invention, the machine tool comprises a common supporting structure for at least the internal roll carriers and the tube holder so that, since now there is a re-arrangement of the common means mounting the work holder and the inner rolls, there is no longer any need to have any part of the machine tool obstruction extension of the tube as in US patent 3,287,951 and such tube may now accordingly extend in the axial direction to an unlimited extent. It is convenient if not only the carrier of the internal rolls but also the external rolls are mounted in the support structure in a common plane so that they may slide axially in relation thereto.

In accordance with one embodiment of the invention, the carrier for the internal rolls is so arranged that the rolls have their axes at equal distances from the axis of the machine tool and are spaced about such axis at equal angles.

This represents an extremely simple and compact design, in which such a single flat support structure carries all the other parts of the machine tool in a single plane. Around the holder for the workpiece it is possible to slidably mount the carriers for the outer rolls in addition, and the roll carriers and the tubular workpiece are arranged parallel to each other, while the rolls themselves are mounted in the roll carriers so as to be perpendicular to the axis of the tube.

It is therefore possible for the extended tube produced from the originally thick walled blank by wall thickness reduction to freely move between and past the rolls, for example upwards if the machine tool axis is vertical.

In a machine tool in accordance with the invention, the desired feed and rotary movements may be effected by driving the holder and/or the roll carriers. In a preferred embodiment of the invention the workpiece is turned, while the rolls are moved axially along the workpiece. In order to make this possible, the holder for the workpiece is arranged so that it may be turned in the support structure and it is provided with a suitable drive, whereas the roll carriers are preferably in the form of three or more columns, which are arranged in the carrier structure within plan bushes so that they may slide axially. The roll carriers are moved by lead screws and a suitable drive therefor.

In order to make it possible for the blanks and the tubes produced to have different diameters, the rolls are arranged so that they may be adjusted radially in relation to the axis of the machine tool. It is then possible for the radial position of the rolls to be coarsely set using plugs and sets of holes. For fine setting there is a wedge by which the desired setting of the rolls may be precisely adjusted. The wedges are able to efficiently resist the full force acting on the rolls.

A further advantage of the design principle of the machine tool in accordance with the invention is that it is suitable for the production of a full size range of tubes extending from small to large sizes with the same or different diameters. For the manufacture of small tubes the apparatus may be designed so that the axis is horizontal. For large-size tubes the arrangement may be one with a vertical axis, in which the support structure is a foundation with the roll carriers extending upwards from it. Such machine tools are used for the production of components within a size range of 0.4 to 8 meters in diameter, a prerolling wall thickness of 4 to 100 mm, a finished wall thickness of 1 to 30 mm and a finished length of 0.5 to 16 meters.

In accordance with a further development of the invention, four pairs of rolls are provided with the external rolls placed at the corners of a square ring which forms a part of the external roll carrier. In this arrangement the sides of such a square roll carrier are subjected to minimum flexure stress despite the heavy load on the rolls borne by the carrier. There is preferably a diametral arrangement of the four internal rolls and this means that the internal roll carrier is only subjected to compression forces. As a result of this the design of the roll carriers is relatively elementary since a suitable selection of the material and the thickness thereo will lead to the necessary tensile and compressive load carrying capacity.

The apparatus in keeping with the invention may be used not only for the production of very large tubes but also for both small and large tubes to be manufactured with a high degree of precision. Owing to the possibility of radial adjustment of the rolls it is furthermore readily possible to produce tubes with different diameters or with grooves and the like.

It is preferred for the internal rolls to have a smaller diameter than the external rolls in order to ensure the same size of contact area between the roll and the face of the workpiece both internally and externally. Consequently the same pressing force on the rolls will result in an even rolling deformation and a change in the thickness of the wall without any change in the "mean diameter", (i.e. half the sum of the internal and external diameters) of the blank.

The pairs of rolls are preferably offset in relation to each other in the axial direction. By setting the pairs of rolls with a gap decreasing in width in the direction of rolling it becomes possible to produce very long tubes in the tube rolling process, since each pair of rolls makes its own contribution to the extending deformation (due to wall thickness reduction).

The invention will now be described with reference to the accompanying diagrammatic drawings showing some embodiments of the invention by way of example only.

DETAILED DESCRIPTION OF THE EMBODIMENTS OF THE INVENTION

Figure 1:
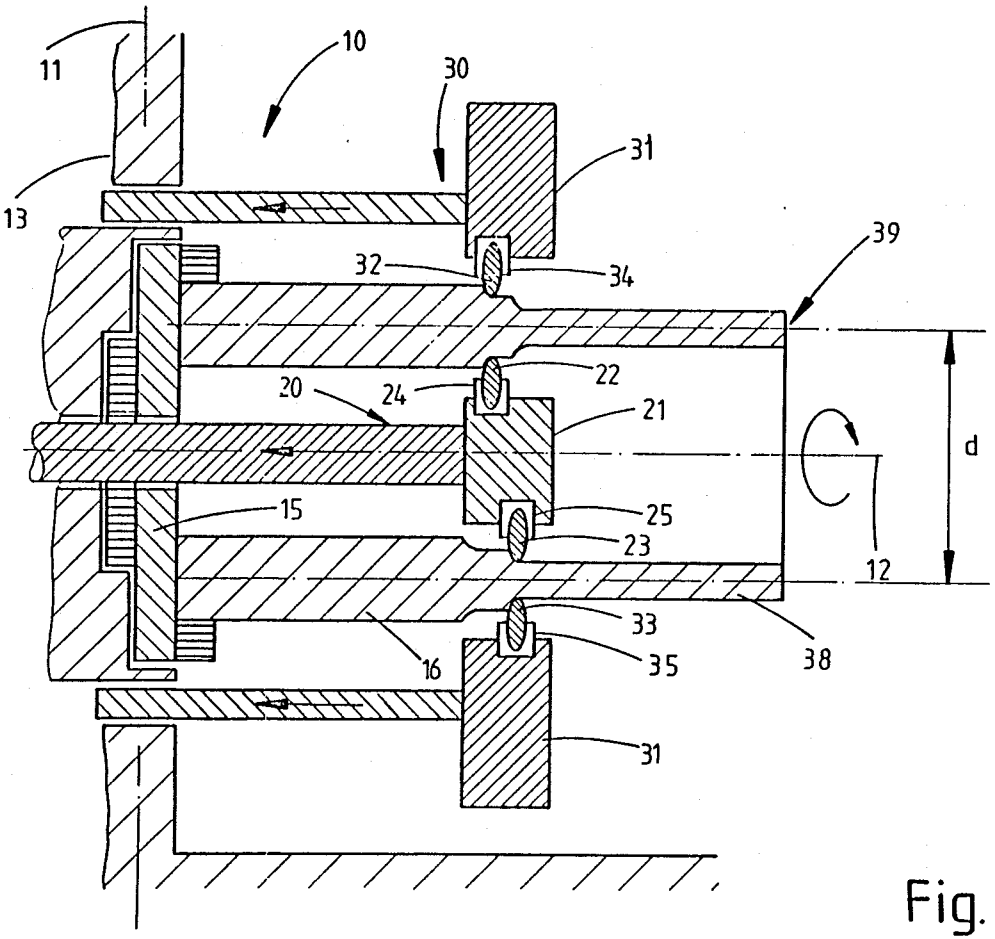
FIG. 1 shows a diagrammatic axial section through a first embodiment of the invention in which the wall thickness of a tubular workpiece is being reduced in two stages.

FIG. 1 shows a machine tool 10 for rolling the wall of a tubular blank which is so placed that its axis is horizontal. The various parts of the machine tool project to the right from a connection base which is denoted by a plane 11 which is upright and is consequently perpendicular to the machine tool axis 12. The machine tool comprises a support structure 13 at the plane, supporting a holder 15 in which the tubular workpiece or tube 16 is clamped and which is mounted in the support structure 13 so that it may rotate. There is an internal roll carrier 20 which may be moved along the machine tool axis 12. The roll carrier 20 comprises a head 21 in which two wall rolling rolls 22 and 23 are mounted in radially adjustable holders 24 and 25 respectively. Radially spaced from the workpiece there is a second, external roll carrier 30 in whose annular head 31 there are external counter rolls 32 and 33 aligned for cooperation with the inner rolls 22 and 23 in reducing the wall thickness of the workpiece. These rolls 32 and 33 are also able to be set by virtue of their being arranged in radially adjusting holders 34 and 35, respectively. The external roll carrier 30 has horizontal columns, running in bushes in the support structure so that this carrier may be shifted axially.

The roll carriers 20 and 30, which are parallel to each other, are supported together with the workpiece holder 15 in the same plane 11 in such a way that they project in cantilever fashion from the connection base and it is not necessary to have any transverse connections between them at the other end of the tube 39 which otherwise would form an obstruction and limit the length of the workpiece 16 and of the tube 39 or other article produced by tube rolling. In other words, all the connections between the separate machine tool parts are at the one end of workpiece 16 where the latter is itself held in place. On the other hand, the radial face 39 of the opposite end 38 of the workpiece 16 is free and exposed so that there are no limits, in the form of obstruction, as regards the length of the tubes to be produced.

In the tube rolling process the workpiece 16 is firstly clamped in the holder 15 and the roll carrier 30 is so set in the axial direction in accordance with the length of the blank that the first pair of rolls 22 and 32 is at the free end face 39 of the workpiece and the second pair of rolls 23 and 33 is not yet in engagement with the tube. The holder 15 is then caused to rotate by means of a drive which is not shown, while at the same time the roll heads 21 and 32 of the carriers 20 and 30 are fed at a steady rate in the direction of the arrow towards the support structure, i. e. towards the left.

The machine tool is set so that the radial spacing between the rolls 22 and 32 on the one hand and 23 and 33 on the other and the force exerted by them is in accord with the wall thickness of the blank which is to be rolled and made thinner. The speed of rotation of the holder 15 and the rate of feed of the roll carriers 30 and 20 have to be set in accordance with this criterion as well, i. e. the achieve a condition in which the rolls of a pair are pressed together with the desired decrease in the thickness of the wall of the workpiece and a simultaneous increase in the length of the workpiece 16. The wall rolling deformation is caused partly by the one roll pair 22 and 32 and partly by the other roll pair 23 and 33 so that one may speak of a reduction in two half stages or passes in the wall thickness with the sum of the two reductions equal to the reduction that would be necessary if only one pair of rolls were to be utilized.

Owing to the possibility of radial adjustment of the rolls 22, 23, 32 and 33 the machine tool 10 may be used to produce tubes 16 with different diameters, the internal and external rolls causing the same degree of deformation so that the mean diameter d (half the sum of the external and internal diameters) of the tube 16 after wall reduction may be set with a high degree of precision if the pairs of rolls are respectively set to be symmetrical to the wall of the blank 16, i.e. to extend radially equal amounts into it from inner and outer sides.

Owing to the adjustable construction of the machine tool 10 it is possible to produce tubes with one machine tool whose dimensions are within certain limits. For producing tubes with a very large diameter, as for example of the order of meters, and with a length exceeding this, it is preferred to use a machine tool operating with an upright axis of rotation and whose parts are supported by a foundation as part of the building housing the machine tool so that they are able to move rather than having a support structure which is part of the machine tool.

Figure 2:
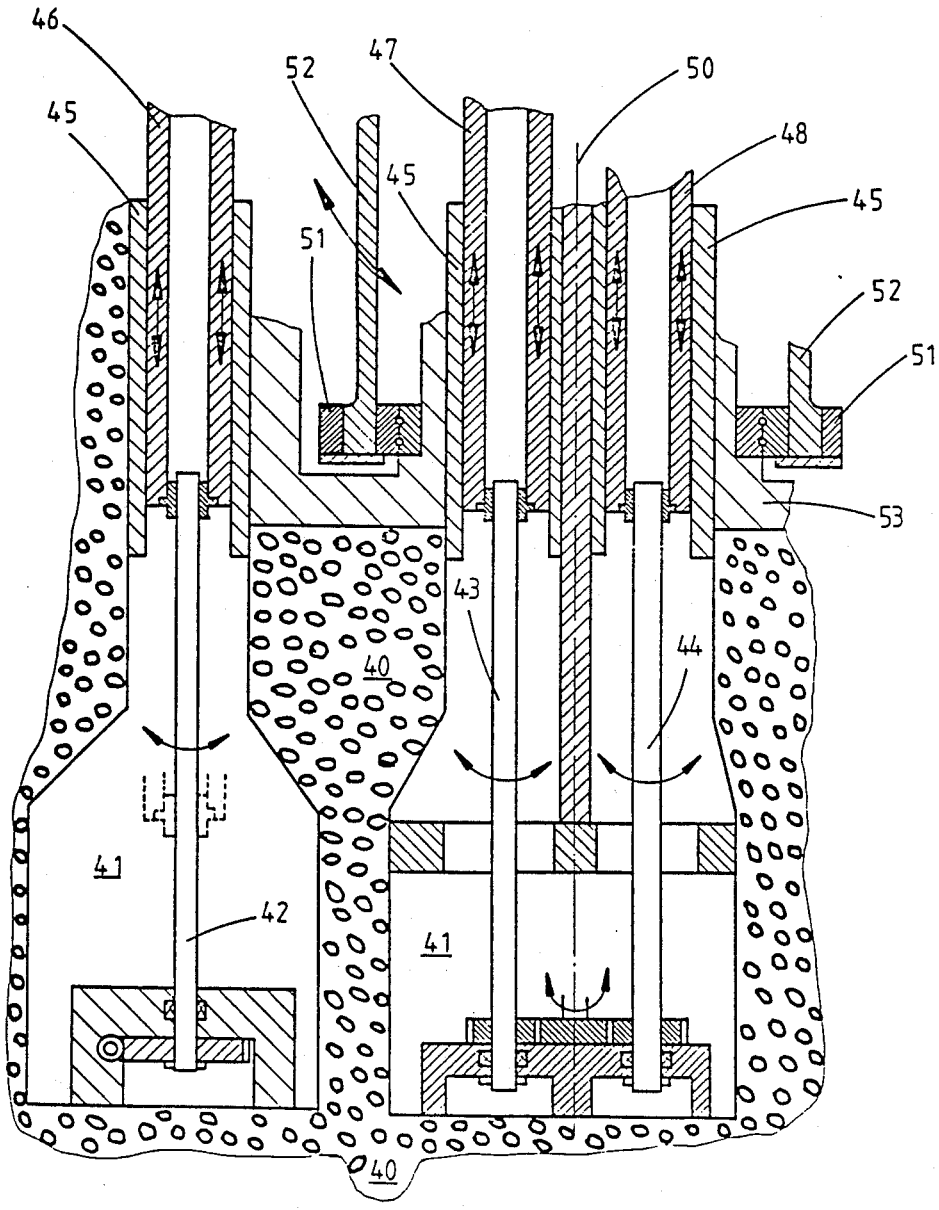
FIG. 2 is a section through a foundation in which parts of the lower end of a machine tool in accordance with the invention are embedded.

FIG. 2 shows part of such a tube or ring rolling machine tool mounted in a foundation 40, in which there are shafts 41 in which respective vertical lead screws 42, 43 and 44 are supported for rotation about their axes. The lead screws 42 to 44 run in and support columns 46 to 48 for moving them upwards and downwards. The columns are guided by bushes 45.

FIG. 2 only shows a part of the machine tool in cross section. Its axis of rotation is designated by numeral 50. The drawing shows the lower part of the internal roll carrier arranged about the axis 50, and of the external roll carrier only one column is shown in section (to the left in FIG. 2). Together with a head, not shown, and possibly further columns, the axially moving centrally placed tubular columns 47 and 48 form the internal roll carrier and they are at equal radial distances from the machine tool axis and equally angularly spaced about it. The holder 51 for the workpiece 52 is joined with the foundation 40 by a metal support 53. The metal support 53 also carries the bushes 45 for the columns 47 and 48 of the internal roll carrier. In conjunction with the head, not shown, there are at least three tubular columns 46 spaced out equally about the axis of the machine tool and at equal radial distances therefrom to form the external roll carrier.

Figure 3:
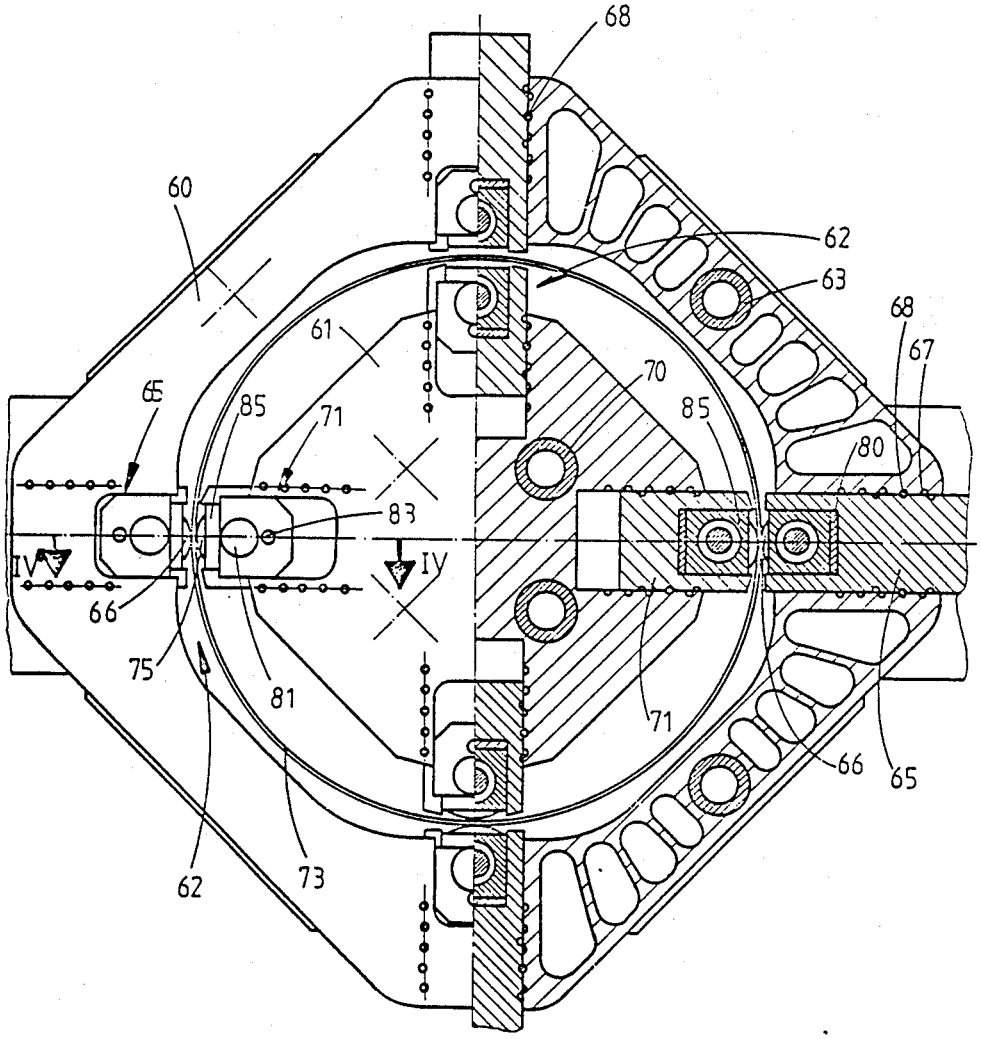
FIG. 3 is a view of the roll carrying assembly of a further embodiment of the invention.

FIG. 3 shows an example of an external head 60, and of an internal head 61 with four pairs of rolls 62, in more detail and looking along the axis of the machine tool with partial sectioning. The external head 60 comprises a square ring of metal, which together with four columns 63 forms the external roll carrier. At the corners of the ring there are respective external roll holders 65. The roll holders 65 are in the form of blocks able to slide radially within the external head 60 and each has a roll 66 mounted at its radially inner end. For locking the holder 65 in different radial settings there are semicylindrical grooves 67 in the internal surfaces of engagement on the head 60 and the respective roll holders 65. A pin 68 may then be inserted into a pair of coinciding grooves so that the holder 65 is locked at a given setting. The grooves 67 in the holders and those in the head are regularly spaced in the radial direction but the grooves in the head have a smaller pitch than those in the holders to allow finer adjustment.

The internal head 61 is also a square metal member carried by four columns 70 and in its corner parts there are roll holders 71 similar to those provided in the external head 60 so that they may be shifted and radially set in a similar way.

Owing to the provision of four diametrally arranged pairs of rolls 62 with the rolls of each pair radially aligned, on the application of the high rolling pressures, with which the pairs of rolls act against the wall of the workpiece 73, a favorable distribution of stresses becomes established, which are able to be fully counteracted by the heads 60 and 61 so that there is hardly any load on the columns 63 and 70 owing to this field of forces. Furthermore, the four pairs of rolls 62 offer the opportunity of producing very long tubes from relatively thick-walled (and accordingly shorter) tubular blanks by so arranging the four pairs of rolls 62 that there are four stages or passes in the reduction in wall thickness and extension of the blank.

The heads in accordance with FIG. 3 are, for example, suitable for the machine of FIG. 2, the columns 63 and 70 corresponding to the columns 46 to 48 and further columns that are not illustrated in FIG. 2.

The radial positioning and attachment system shown in FIG. 3, and described above for the roll holders using pins 68, is only for the purposes of coarse adjustment and for fine adjustment there are respective wedges.

Figure 4:
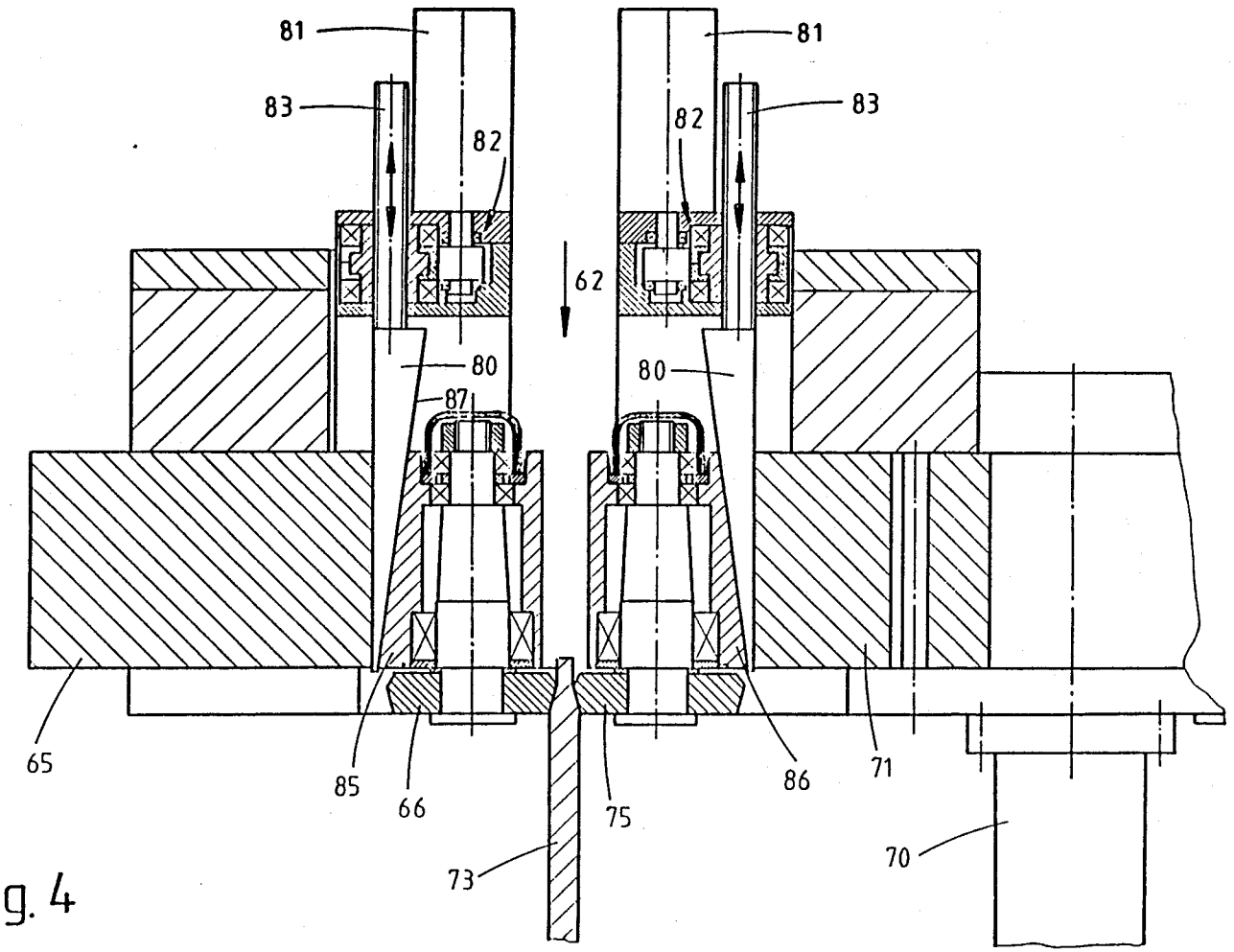
FIG. 4 is a section taken on line IV—IV in FIG. 3 on a larger scale.

This mechanism for fine adjustment is to be seen in the larger-scale section in FIG. 4 clearly showing vertically movable adjustment wedges 80 at the backs of roll bearing assemblies 85 and 86 and radially supported by the roll holders 71 and 65. After the external roll 66 and the internal roll 75 have been roughly positioned by shifting their roll holders 65 and 71, respectively, 71 radially, a drive 81 is operated which through a transmission 82 moves a respective lead screw 83 upwards or downwards dependent on the direction of rotation of the drive. Accordingly the respective wedge 80 attached to the lower end of the lead screw 83 is moved downwards (for example) further into the space between the roll holders 65 and 71 and the respective roll bearing assemblies 85 and 86 so that the rolls 66 and 75 are moved radially in opposite directions towards each other; when on the contrary the wedges 80 are moved upwards the rolls 75 and 66 are moved radially away from each other. The bearing assemblies 85 and 86, the wedges 80 and the wedge drives all form parts of the radially shifting roll holders 65 and 71.

For coarse adjustment, the roll holders 65 and 71 are moved bodily, i. e. with the bearing assemblies 85 and 86 so that the rolls 66 and 75 are moved towards the wall of the workpiece 73. For fine adjustment, only the bearing assemblies 85 and 86 are moved separately from the rest of the roll holders by moving the wedges 80 upwards or downwards so that the roll holders 65 and 71 are moved towards the wall of the workpiece or retracted further therefrom, the rolls being shifted radially in the latter case by spring means.

This adjustment system has the advantage of not only being relatively simple but furthermore of being able to withstand the full stress itself rather than having to have a separate locking means to be operated after the rolls have been brought into the desired radial positions. Owing to the slope 87 of the wedges the radial force is hardly converted into an axial component.

We claim:

1. An apparatus for rolling the wall of a tubular workpiece to reduce its wall thickness, comprising:

base means extending radially of an axis and defining a plane perpendicular thereto, said base means including a frame structure;

a workpiece holder for supporting a workpiece so that it is centered on said axis;

an internal roll carrier, means attached to said frame structure supporting said internal roll carrier inside said workpiece holder in radial symmetry with respect to said axis;

a pair of internal rolls, roll support means on said internal roll carrier supporting said internal rolls in diametric opposition on said internal roll carrier;

an external roll carrier, means attached to said frame structure supporting said external roll carrier around said workpiece, a pair of external rolls, roll support means on said external roll carrier supporting said external rolls in diametric opposition on said external roll carrier such that the internal and external rolls face one another and form wall-rolling pairs each of which defines a rolling nip for reducing the thickness of the wall of the workpiece;

said means which supports said internal and external roll carriers from said frame structure providing axial movement for each of the roll carriers relative to said frame structure;

means supporting said workpiece holder from said frame structure so that relative axial feed motion and relative rotation about said axis may take place between said workpiece and said pairs of rolls; and drive means for producing said relative axial motion and said relative rotation between said rolls and said workpiece.

2. The apparatus as claimed in claim 1 comprising means rotatably supporting said workpiece holder from said frame structure.

3. The apparatus as claimed in claim 1 wherein said carriers each respectively comprises axially extending columns and bushes for guiding said columns in axial movement independently of one another.

4. The apparatus as claimed in claim 3 comprising lead screws for axially moving each of the roll carriers and a common drive for rotating said lead screws.

5. The apparatus as claimed in claim 3 comprising lead screws for axially moving each of the roll carriers and separate drives for rotating said lead screws in synchronism.

6. The apparatus as claimed in claim 1 comprising means for separately adjusting said rolls radially in their respective means.

7. The apparatus as claimed in claim 6 comprising a coarse radial adjustment means and a fine radial adjustment means for setting the size of the rolling nip and the radial position thereof.

8. The apparatus as claimed in claim 7 wherein said fine adjustment means comprises wedge means.

9. The apparatus as claimed in claim 1 wherein said roll support means for said external rolls comprises a square ring with four of said internal rolls mounted at the four corners of said square ring.

10. The apparatus as claimed in claim 1 wherein said base means is constituted by the foundation of a building.

11. The apparatus as claimed in claim 1 wherein said internal rolls have a smaller diameter than said external rolls.

12. The apparatus as claimed in claim 1 wherein the pairs of internal and external rolls are axially staggered for rolling said wall of said workpiece in a plurality of passes.

13. The apparatus as claimed in claim 1 wherein said carriers and said workpieces are supported by said frame structure in cantilever fashion without any transverse connection therebetween.

* * * * *